US009311875B2

(12) United States Patent
Choi et al.

(10) Patent No.: US 9,311,875 B2
(45) Date of Patent: Apr. 12, 2016

(54) DISPLAY DEVICE

(71) Applicant: Samsung Display Co., Ltd., Yongin (KR)

(72) Inventors: Hak-Mo Choi, Seoul (KR); Jong-Hee Na, Cheonan-si (KR); Gwangho Nam, Asan-si (KR); Hoisik Moon, Asan-si (KR); Chang-Soo Lee, Cheonan-si (KR); Min-Yup Chae, Cheonan-si (KR); Jae-Suk Choi, Uijeongbu-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 95 days.

(21) Appl. No.: 13/891,485

(22) Filed: May 10, 2013

(65) Prior Publication Data

US 2014/0176407 A1 Jun. 26, 2014

(30) Foreign Application Priority Data

Dec. 24, 2012 (KR) ..... 10-2012-0152355

(51) Int. Cl.
*G09G 3/00* (2006.01)
*G09G 3/36* (2006.01)

(52) U.S. Cl.
CPC ..... *G09G 3/3648* (2013.01); *G09G 3/3677* (2013.01); *G09G 2310/06* (2013.01); *G09G 2360/18* (2013.01)

(58) Field of Classification Search
CPC ..... G09G 3/30; G09G 5/10; G09G 3/3648; G09G 3/3688; G09G 3/3677; G09G 3/3614; G09G 2310/08; G09G 3/20; G09G 3/044; G09G 3/0412; G09G 3/041
See application file for complete search history.

(56) References Cited

U.S. PATENT DOCUMENTS

| | | | | |
|---|---|---|---|---|
| 6,842,161 | B2 | 1/2005 | Song et al. | |
| 7,193,599 | B2 | 3/2007 | Kim et al. | |
| 7,812,833 | B2 | 10/2010 | Kim et al. | |
| 2008/0088583 | A1 | 4/2008 | Cho et al. | |
| 2012/0098813 | A1 | 4/2012 | Park et al. | |
| 2012/0256971 | A1 * | 10/2012 | Shin et al. | 345/690 |
| 2012/0274748 | A1 * | 11/2012 | Hwang | G02B 27/26 348/51 |
| 2012/0320018 | A1 * | 12/2012 | Saitoh et al. | 345/209 |

FOREIGN PATENT DOCUMENTS

| | | |
|---|---|---|
| JP | 2001-033759 | 2/2001 |
| JP | 2008-242206 | 10/2008 |
| KR | 10-0206584 | 4/1999 |
| KR | 10-0697363 | 3/2007 |
| KR | 1020080017917 | 2/2008 |
| KR | 10-0840324 | 6/2008 |
| KR | 1020080053598 | 6/2008 |
| KR | 1020120074572 | 7/2012 |

* cited by examiner

*Primary Examiner* — Michael Faragalla
(74) *Attorney, Agent, or Firm* — H.C. Park & Associates, PLC

(57) ABSTRACT

A display device includes pixels respectively arranged in areas defined by gate lines and data lines, a gate driver that drives the gate lines in response to a gate pulse signal, a data driver that drives the data lines in response to a clock signal and a data signal, and a timing controller that applies the clock signal and the data signal to the data driver and the gate pulse signal to the gate driver in response to an image signal and a control signal. The timing controller periodically changes a pulse width of each of the gate pulse signal and the clock signal.

18 Claims, 9 Drawing Sheets

DISPLAY DEVICE

CROSS REFERENCE TO RELATED APPLICATION

This application claims priority from and the benefit of Korean Patent Application No. 10-2012-0152355, filed on Dec. 24, 2012, which is hereby incorporated by reference for all purposes as if fully set forth herein.

BACKGROUND OF THE INVENTION

1. Field of the Invention

Exemplary embodiments of the invention relate to a display device having improved display quality.

2. Discussion of the Background

In general, a display device includes a display panel that displays an image, and data and gate drivers that drive the display panel. The display panel includes gate lines, data is lines, and pixels. Each pixel includes a thin film transistor, a liquid crystal capacitor, and a storage capacitor. The data driver applies a data driving signal to the data lines and the gate driver applies a gate driving signal to the gate lines.

The display device applies a gate on voltage to a gate electrode of the thin film transistor connected to the gate line, and applies a data voltage to a source electrode of the thin film transistor, which results in the display of a desired image. The data voltage, which is charged in the liquid crystal capacitor and the storage capacitor while the thin film transistor is turned on, is maintained for a predetermined time after the thin film transistor is turned off. However, some of the gate signals output from the gate driver and the data signals output from the data driver may be delayed since the display panels have become large in size and have adopted a high-speed driving method. Accordingly, the charge amount of the liquid crystal capacitors located relatively far from the gate and data drivers is lower than the charge amount of the liquid crystal capacitors located relatively closer to the gate and data drivers. As a result, the image becomes non-uniform in one display panel.

SUMMARY OF THE INVENTION

Exemplary embodiments of the invention provide a display device having improved display quality.

Additional features of the invention will be set forth in the description which follows, and in part will be apparent from the description, or may be learned by practice of the invention.

Exemplary embodiments of the invention disclose a display device including a plurality of pixels, a gate driver, a data driver, and a timing controller. The plurality of pixels is is configured by a plurality of gate lines and a plurality of data lines. The data driver is configured to drive the data lines in response to a first control signal and a data signal. The gate driver is configured to drive the gate lines in response to a second control signal. The timing controller is configured to apply the first control signal and the data signal to the data driver and the second control signal to the gate driver in response to receiving an image signal and a third control signal. The timing controller is configured to periodically change a pulse width of each of the second control signal and the first control signal.

Exemplary embodiments of the invention also disclose a display device including a timing controller, a gate driver, and a data driver. The timing controller is configured to provide a first control signal and a second control signal. The gate driver is configured to provide gate signals to a plurality of gate lines according to the second control signal. The data driver configured to provide data signals to a plurality of data lines according to the first control signal. A first gate line of the plurality of gate lines is disposed between the data driver and a second gate line of the plurality of gate lines. The gate driver is configured to set a pulse width of a first gate signal applied to the first gate line to be shorter than a pulse width of a second gate signal applied to the second gate line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, is illustrate exemplary embodiments of the invention, and together with the description serve to explain the principles of the invention.

DETAILED DESCRIPTION OF THE ILLUSTRATED EMBODIMENTS

Figure 1:
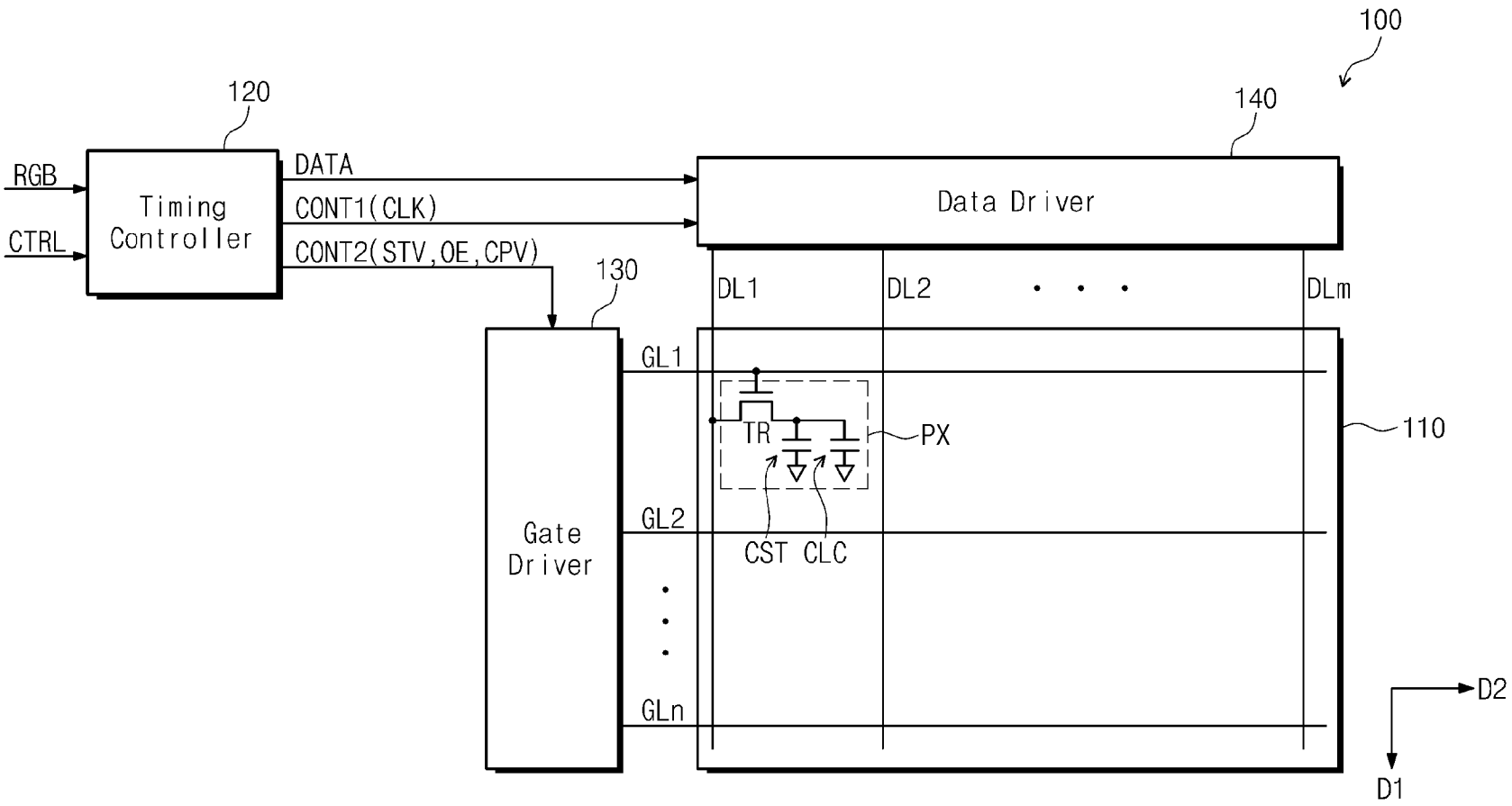
FIG. 1 is a block diagram showing a display device according to exemplary embodiments of the invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. It may also be understood that for the purposes of this disclosure, "at least one of X, Y, and Z" can be construed as X only, Y only, Z only, or any combination of two or more items X, Y, and Z (e.g., XYZ, XYY, YZ, ZZ).

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed is below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing exemplary embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, exemplary embodiments of the present invention will be described in detail with reference to the accompanying drawings.

FIG. 1 is a block diagram showing a display device according to exemplary is embodiments of the invention.

Referring to FIG. 1, a display device 100 may include a display panel 110, a timing controller 120, a gate driver 130, and a data driver 140.

The display panel 110 may include a plurality of data lines DL1 to DLm extended in a first direction D1, a plurality of gate lines GL1 to GLn extended in a second direction D2 to cross the data lines DL1 to DLm, and a plurality of pixels PX arranged in areas defined by the data lines DL1 to DLm and the gate lines GL1 to GLn, e.g., a matrix form (each of "n" and "m" is a natural number greater than 0). The data lines DL1 to DLm are insulated from the gate lines GL1 to GLn.

Each pixel PX may include a switching transistor TR connected to a corresponding data line of the data lines DL1 to DLm and a corresponding gate line of the gate lines GL1 to GLn, a liquid crystal capacitor CLC connected to the switching transistor TR, and a storage capacitor CST connected to the switching transistor TR.

The pixels PX in the display panel 110 may have the same structure. Therefore, hereinafter one pixel will be described as a representative example. The switching transistor TR may include a gate electrode connected to a first gate line GL1 of the gate lines GL1 to GLn, a source electrode connected to a first data line DL1 of the data lines DL1 to DLm, and a drain electrode connected to the liquid crystal capacitor CLC and the storage capacitor CST. One terminal of each of the liquid crystal capacitor CLC and the storage capacitor CST is connected to the drain electrode of the switching transistor TR in parallel, and the other terminal of each of the liquid crystal capacitor CLC and the storage capacitor CST is connected to a common voltage (e.g., ground node). The switching transistor may be, but is not limited to, a thin film transistor.

The timing controller 120 may receive image signals RGB and control signals CTRL, e.g., a vertical synchronization signal, a horizontal synchronization signal, a main clock signal, a data enable signal, etc., to control a data signal DATA, a first control signal CONT1 and a second control signal CONT2. The timing controller 120 may convert the image signal RGB to data signal DATA according to the image to be displayed on the display panel 110 on the basis of the control signals CTRL. The timing controller 120 may apply the data signal DATA and a first control signal CONT1 to the data driver 140 and a second control signal CONT2 to the gate driver 130. The first control signal CONT1 may include a horizontal synchronization start signal, a clock signal CLK, and a line latch signal, and the second control signal CONT2 may include a vertical synchronization start signal STV, an output enable signal OE, and a gate pulse signal CPV.

The data driver 140 outputs data driving signals to drive the data lines DL1 to DLm in response to the data signal DATA and the first control signal CONT1 from the timing controller 120.

The gate driver 130 outputs a gate on voltage and a gate off voltage to drive the gate lines GL1 to GLn in response to the second control signal CONT2 from the timing controller 120. The gate driver 130 may include one or more gate driver ICs, but is not be limited thereto.

The gate driver 130 may be configured to include a circuit made of oxide semiconductor, amorphous semiconductor, crystalline semiconductor, or polycrystalline semiconductor.

When the gate on voltage is applied to one gate line, switching transistors arranged in one row and connected to the one gate line are turned on. In this case, the data driver 140 provides the data driving signals corresponding to the data signal DATA to the data lines DL1 to DLm. The data driving signals applied to the data lines DL1 to DLm are applied to corresponding pixels through the turned-on switching transistors. A period during which the switching transistors corresponding to one row are turned on, e.g., one period of the output enable signal OE, may be referred to as "one horizontal period" or "1H". The one period of the output enable signal OE includes a horizontal data period HD in which effective data signal DATA is output and a horizontal blank period HB. The horizontal data period HD and the horizontal blank period HB of the output enable signal OE may be changed at every predetermined period.

When a size of the display panel 110 becomes large, a length of the data lines DL1 to DLm and the gate lines GL1 to GLn also increases. As the length of the data lines DL1 to DLm increases, a time required to transmit the data driving signals through the data lines DL1 to DLm becomes longer. In addition, as the length of the gate lines GL1 to GLn increases, a time required to transmit the gate driving signals through the gate lines GL1 to GLn becomes longer. Therefore, the amount a liquid crystal capacitor in the pixels is charged may vary according to a position of the pixel connected to the gate lines GL1 to GLn and the data lines DL1 to DLm. For instance, among the pixels connected to one data line of the data lines DL1 to DLm, the amount the liquid crystal capacitor of the pixels positioned closer to the data driver 140 that outputs the data driving signals is charged is higher than the amount the liquid crystal capacitor of the pixels positioned further away from the data driver 140 is charged. In addition, the amount a liquid crystal capacitor in the pixels is charged may change according to a direction in which the gate lines GL1 to GLn are scanned.

The timing controller 120 may change the horizontal data period HD and the is horizontal blank period HB of one period of the output enable signal OE such that a pulse width of the gate driving signal applied to the gate lines positioned far away from the data driver 140 in the first direction D1 is increased. When the pulse width of the gate driving signal applied to the gate lines is increased, the amount a liquid crystal capacitor CLC in the pixels PX is charged may increase. In some cases, the gate lines GL1 to GLn may be scanned from the first gate line GL1 to an n-th gate line GLn. Accordingly, the pulse width may be changed in accordance with the scanning order of the gate lines GL1 to GLn. For instance, in some cases, the gate lines GL1 to GLn may be scanned from the n-th gate line GLn to the first gate line GL1, and the pulse width may be set to be gradually decreased.

Figure 2:
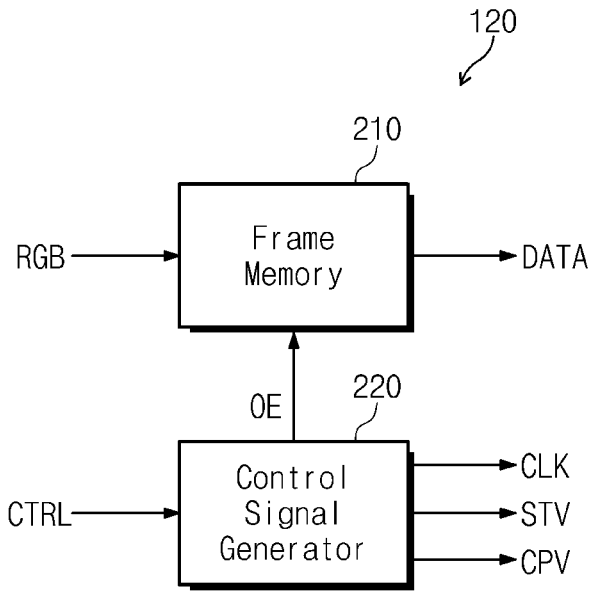
FIG. 2 is a block diagram of the timing controller in FIG. 1 according to exemplary embodiments of the invention.

FIG. 2 is a block diagram showing the timing controller shown in FIG. 1.

Referring to FIG. 2, the timing controller 120 may include a frame memory 210 and a control signal generator 220. The frame memory 210 may store the image signals RGB from an external source (not shown) and output the data signal DATA in response to the output enable signal OE. The control signal generator 220 may generate the output enable signal OE, the clock signal CLK, the vertical synchronization start signal STV, and the gate pulse signal CPV. The first control signal CONT1 generated by the timing controller 120 may include a horizontal synchronization start signal, the clock signal CLK, and a line latch signal. The second control signal CONT2 generated by the timing controller 120 may include the vertical synchronization start signal STV, the output enable signal OE, and the gate pulse signal CPV. A received control signal CTRL may include a data enable signal. The control signal generator 220 may multiply the data enable signal by F (F is a positive integer number) to generate the output enable signal OE. For example, the data enable signal included in the control signal CTRL may have a frequency of about 60 Hz, and the output enable signal OE may have a frequency of about 60 Hz (i.e., F=1), 120 Hz (i.e., F=2), or 240 Hz (i.e., F=4) in accordance with a resolution of the display panel 110.

Figure 3:
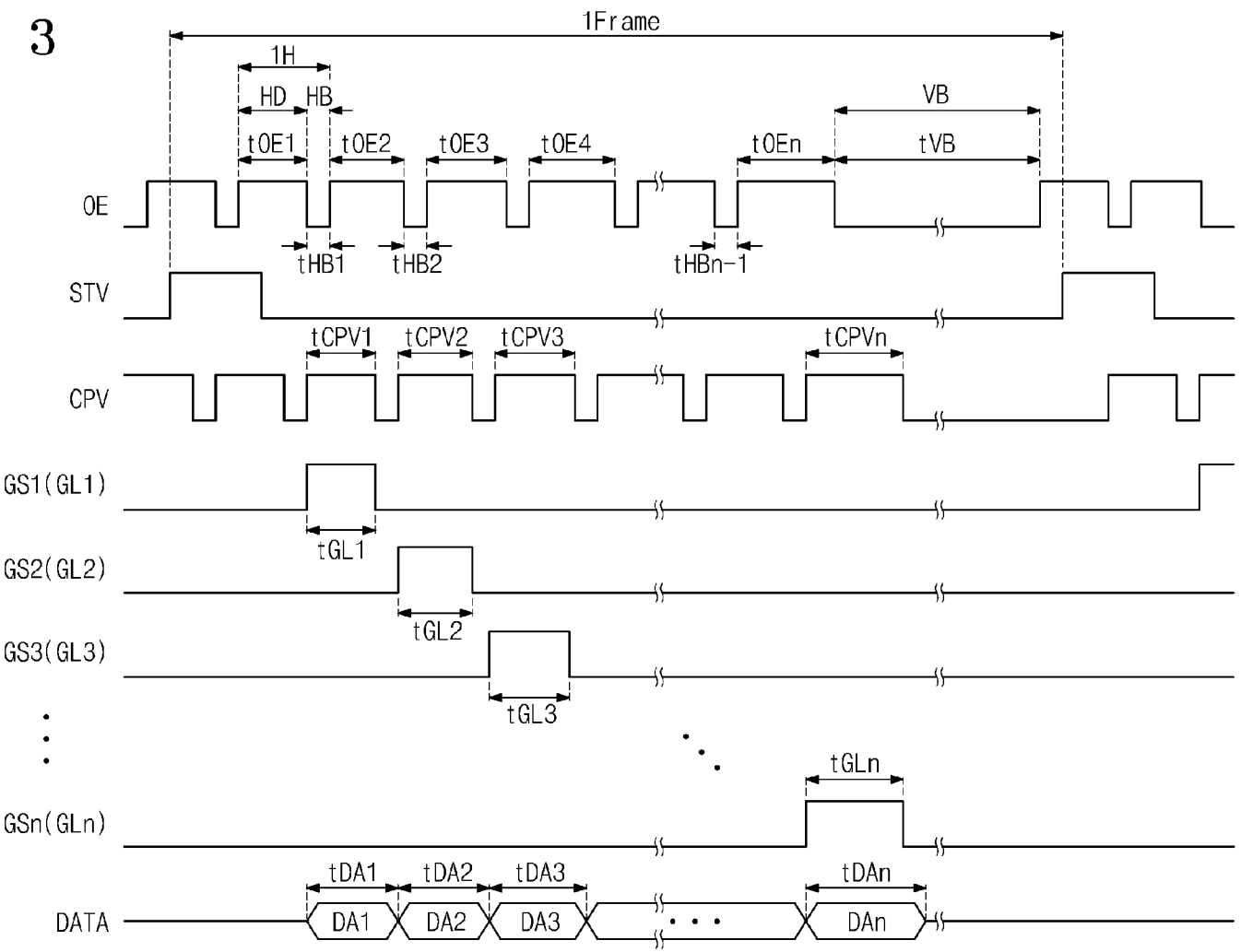
FIG. 3 is a timing diagram showing signals generated by a control signal generator in the timing controller in FIG. 1 and gate driving signals applied to gate lines according to exemplary embodiments of the invention.

FIG. 3 is a timing diagram showing signals generated by the control signal generator 220 in the timing controller 120 shown in FIG. 1 and gate driving signals GS1 to GSn applied to gate lines GL1 to GLn according to exemplary embodiments of the invention.

Referring to FIGS. 1 and 3, the output enable signal OE generated by the timing controller 120 includes n pulses respectively corresponding to the gate lines GL1 to GLn. In one frame, the n pulses of the output enable signal OE have different pulse widths.

The one horizontal period 1H of the output enable signal OE includes the horizontal data period HD with a high level, in which the effective data are output, and the horizontal blank period HB with a low level.

The pulse width of each of the n pulses of the output enable signal OE, i.e., the horizontal data period HD, becomes larger as the gate lines corresponding to the pulses are positioned further away from the data driver 140 in the first direction D1 (tOE1<tOE2<tOE3< . . . <tOEn). In FIG. 3, widths of n horizontal blank periods HB (tHB1=tHB2= . . . =tHBn−1 where n is a natural number other than 0) in the output enable signal OE are shown to be the same.

A frame may include n horizontal periods nH and a vertical blank period VB. When the widths tHB1, tHB2, . . . , tHBn−1 of the n horizontal blank periods HB of the output enable signal OE in the one frame are set to optimized values, the pulse width of the n horizontal data periods HD may be in the order of tOE1<tOE2<tOE3< . . . <tOEn.

The control signal generator 220 of the timing controller 120 may generate the gate pulse signal CPV in response to the output enable signal OE. Pulse widths of the gate pulse signal CPV may be in a similar order as the order of the horizontal data periods HD and may be is in the order of tCPV1<tCPV2<tCPV3< . . . <tCPVn.

The gate driver 130, shown in FIG. 1, may generate the gate driving signals GS 1 to GSn in response to the vertical synchronization start signal STV and the gate pulse signal CPV, which are included in the second control signal CONT2, to sequentially drive the gate lines GL1 to GLn. For instance, after the vertical synchronization start signal STV is activated to a high level, the gate driver 130 may generate a first driving signal GS1 in response to a first pulse signal of the gate pulse signal CPV to drive the first gate line GL1, generate a second driving signal GS2 in response to a second pulse signal of the gate pulse signal CPV to drive the second gate line GL2 , and generate a third driving signal GS3 in response to a third pulse signal of the gate pulse signal CPV to drive the third gate line GL3.

Since the pulse widths of the gate pulse signal CPV are in the order of tCPV1<tCPV2<tCPV3< . . . <tCPVn, the pulse widths of the gate signals GS1 to GSn applied to the gate lines GL1 to GLn have the order of tGL1<tGL2<tGL3< . . . <tGLn. Accordingly, the pulse width of the gate driving signals applied to the gate lines positioned relatively further from the data driver 140 is longer than the pulse width of the gate driving signals applied to the gate lines positioned relatively closer to the data driver 140. When the pulse width of the gate driving signal becomes wide, the turn-on time of the switching transistor TR in the pixel PX is increased. Thus, due to the increase in the turn-on time of the switching transistor TR, a reduction of amount of charge stored, which is caused by the delay of the data driving signal transmitting through the data line, may be compensated.

For instance, in the case of a conventional display device including a display panel having a resolution of 1920 by 1080 and a frame frequency of about 240 Hz (4.15 ms), a sum (tHB1+tHB2+ . . . +tHBn−1) of pulse widths of the horizontal blank period HB in one frame is about 3.75 ms corresponding to about 280 cycles of a main clock signal when the main clock signal included in the control signal CTRL input to the timing controller 120 has a frequency of about 74.52 MHz. In addition, the vertical blank period VB in one frame is about 0.60 ms corresponding to about 45 cycles of the main clock signal.

According to exemplary embodiments of the invention, when the pulse widths of each of the n pulses of the output enable signal OE are set to be different from each other, the sum (tHB1+tHB2+ . . . +tHBn−1) of the pulse widths of the horizontal blank period HB in one frame is about 2.68 ms corresponding to about 200 cycles of the main clock signal. In addition, the vertical blank period VB in one frame is about 0.27 ms corresponding to about 20 cycles of the main clock signal. As described above, the pulse width of the gate driving signals GS1 to GSn may be increased by reducing the horizontal blank period HB and the vertical blank period VB of one frame, and thus the charge time of each pixel may be increased.

Figure 4:
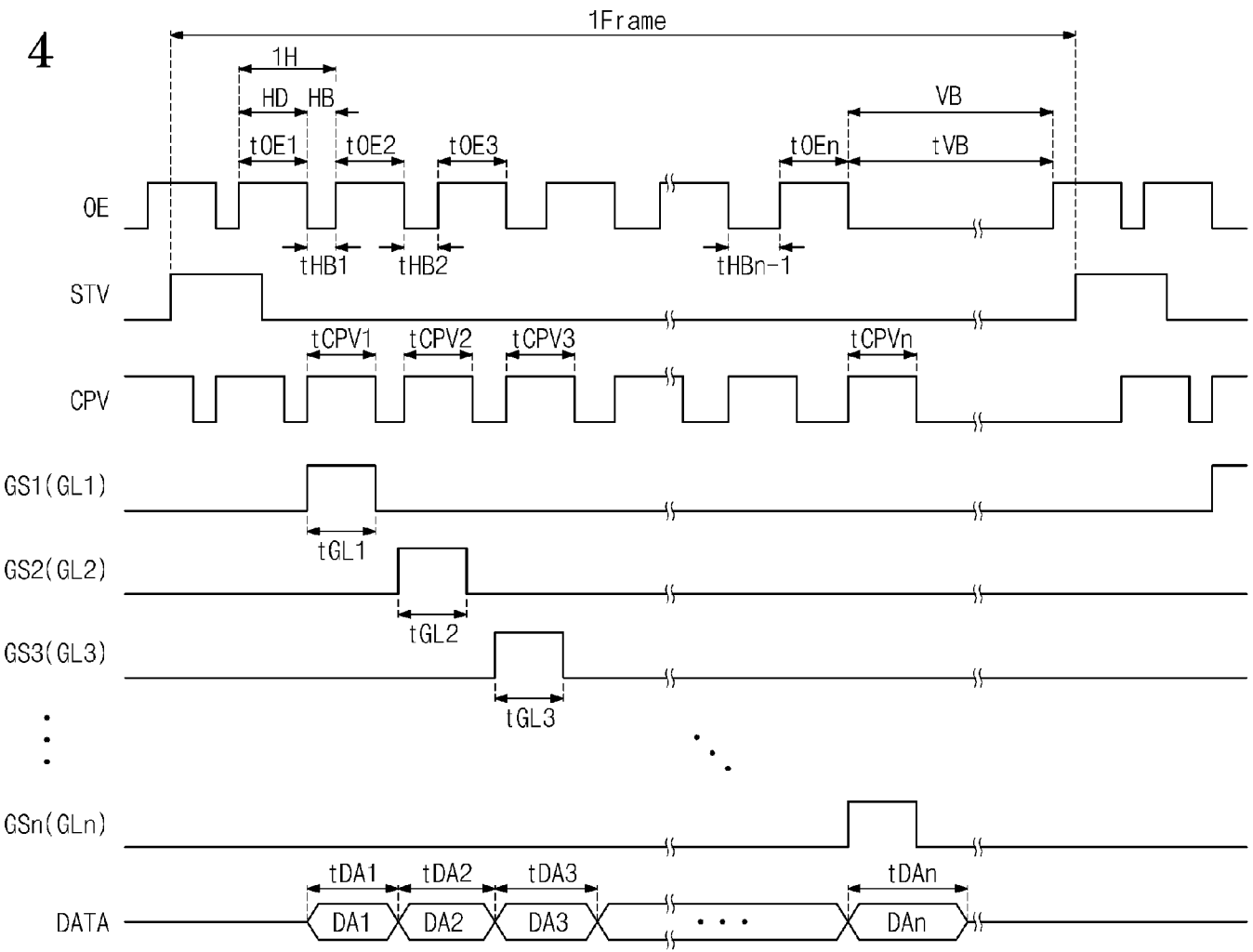
FIG. 4 is a timing diagram showing signals generated by a control signal generator in the timing controller in FIG. 1 and gate driving signals applied to gate lines according to exemplary embodiments of the invention.

FIG. 4 is a timing diagram showing signals generated by the control signal generator 220 in the timing controller 120 shown in FIG. 1 and gate driving signals GS1 to GSn applied to gate lines GL1 to GLn according to exemplary embodiments of the invention.

In FIG. 3, the pulse width of each of the n pulses of the output enable signal OE (i.e., the horizontal data period HD) becomes larger as the gate lines corresponding to the pulses are positioned further away from the data driver 140 in the first direction D1 (tOE1<tOE2<tOE3< . . . <tOEn). However, widths of n horizontal blank periods HB (where n is a natural number other than 0) in the output enable signal OE are the same (tHB1=tHB2= . . . =tHBn−1).

In FIG. 4, the pulse widths of the n pulses of the output enable signal OE are the same (tOE1=tOE2=tOE3= . . . =tOEn); however, the width of the n horizontal blank period HB of the output enable signal OE becomes larger as the gate lines corresponding to the horizontal blank period HB are positioned further away from the data driver 140 in the first direction D1 (tHB1<tHB2< . . . <tHBn−1). As the width of the horizontal blank period HB gradually increases during one frame, one horizontal period (1H) of the output enable signal OE may also gradually increase. One frame includes n horizontal periods nH and the vertical blank period VB. As described above, n horizontal data periods HD may gradually increase (e.g., tHB1<tHB2< . . . <tHBn−1) during one frame by reducing a width tVB of the vertical blank period VB.

Figure 5:
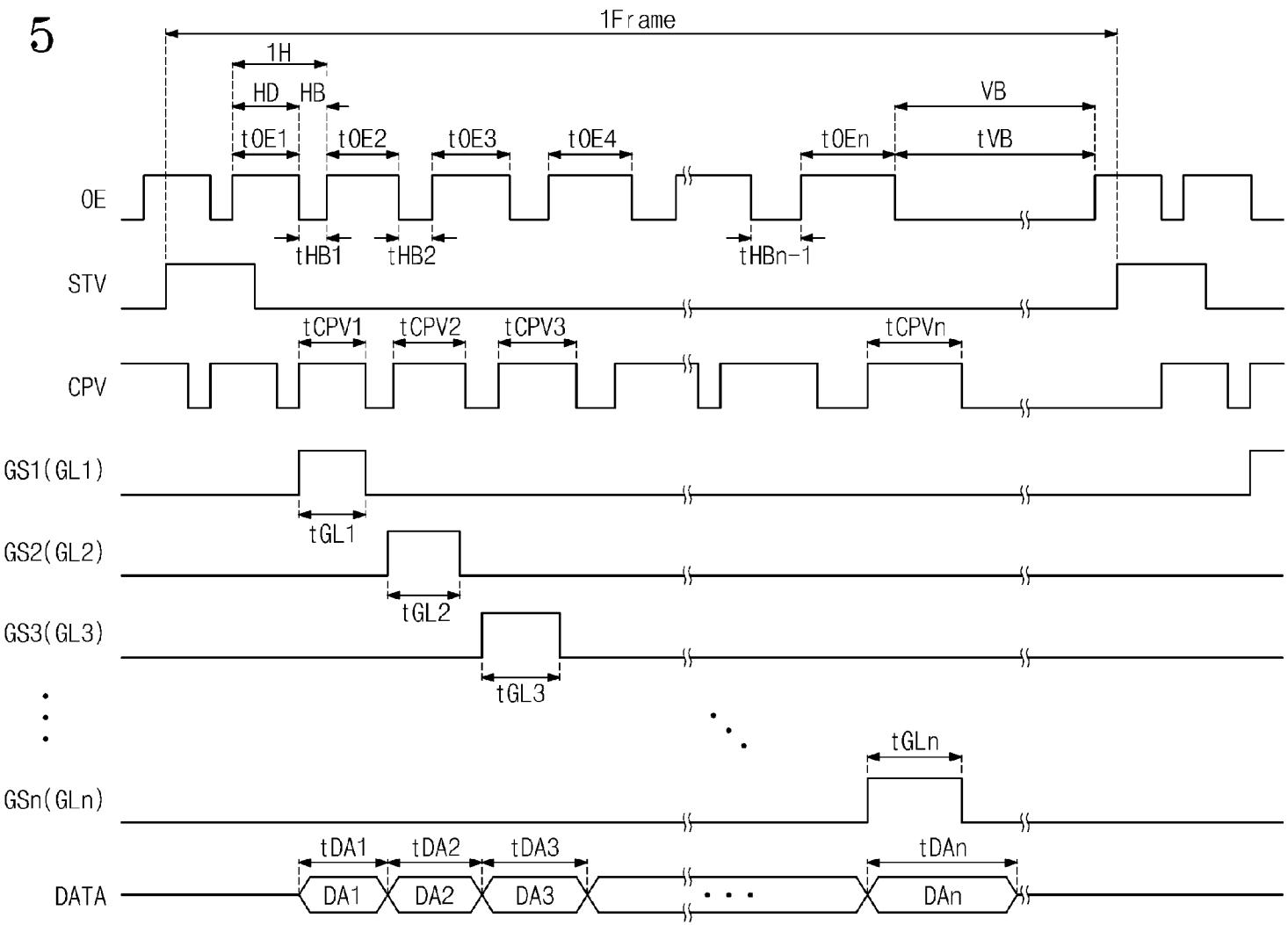
FIG. 5 is a timing diagram showing signals generated by a control signal generator in the timing controller in FIG. 1 and gate driving signals applied to gate lines according to exemplary embodiments of the invention.

FIG. 5 is a timing diagram showing signals generated by the control signal generator 220 in the timing controller 110 shown in FIG. 1 and gate driving signals GS1 to GSn applied to gate lines GL1 to GLn according to exemplary embodiments of the invention.

Referring to FIG. 5, the pulse width of each of the n pulses of the output enable signal OE, i.e., the horizontal data period HD, becomes larger as the gate lines corresponding to the pulses are positioned further away from the data driver 140 in the first direction D1 (e.g., tOE1<tOE2<tOE3< . . . <tOEn). When the pulse width of the gate driving signal becomes larger, the turn-on time of the switching transistor TR in the pixel PX is increased. Thus, due to the increase of the turn-on time of the switching transistor TR, a reduction of the amount of charge stored, which is caused by the delay of the data driving signal transmitting through the data lines DL1 to DLm, may be compensated.

In addition, in FIG. 5, the width of the n horizontal blank period HB of the output enable signal OE becomes larger as the gate lines corresponding to the horizontal blank period HB are positioned further away from the data driver 140 in the first direction D1 (tHB1<tHB2< . . . <tHBn−1). As described above, as the width of the horizontal blank period HB gradually increases during one frame, one horizontal period (1H) of the output enable signal OE also is gradually increases.

Figure 6:
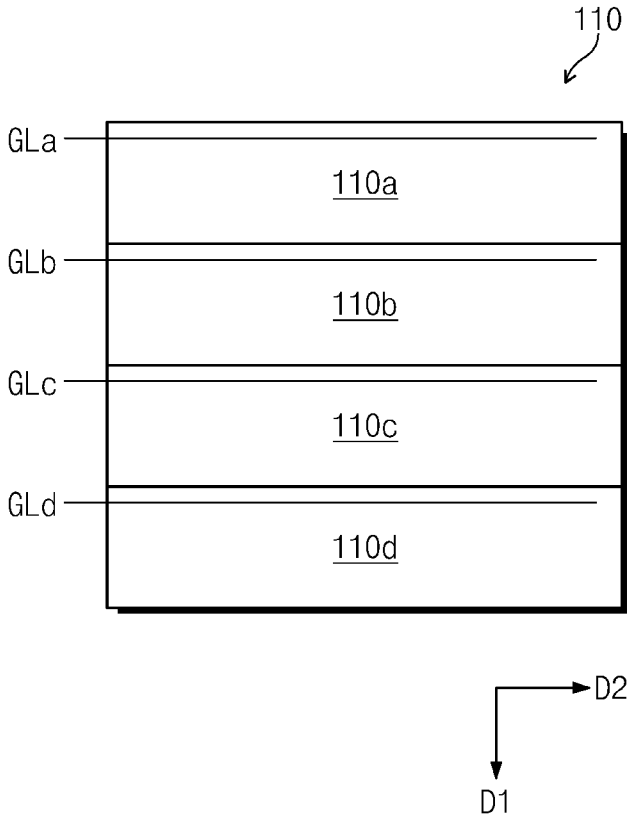
FIG. 6 is a view showing the display panel in FIG. 1 according to exemplary embodiments of the invention.

FIG. 6 is a view showing the display panel 110 shown in FIG. 1.

Referring to FIG. 6, a plurality of display areas 110*a*, 110*b*, 110*c*, and 110*d* are sequentially arranged in the display panel 110 along the first direction D1. The display panel 110 shown in FIG. 6 may include, for example, four display areas 110*a*, 110*b*, 110*c*, and 110*d*. The first gate lines corresponding to the display areas 110*a*, 110*b*, 110*c*, and 110*d* may be referred to as GLa, GLb, GLc, and GLd, respectively. It should be understood that four display areas are shown in FIG. 6 as an example, and that any suitable number of display areas corresponding to gate lines may be provided. In some cases, if the data driver 140 is located in closer proximity to display area 110*a*, a pulse width of the horizontal data period HD and/or the horizontal blank period HB may be larger in gate line GLd compared to gate line GLa. In some cases, if the data driver 140 is located in closer proximity to display area 110*d*, a pulse width of the horizontal data period HD and/or the horizontal blank period HB may be larger in gate line GLa compared to gate line GLd.

Figure 7:
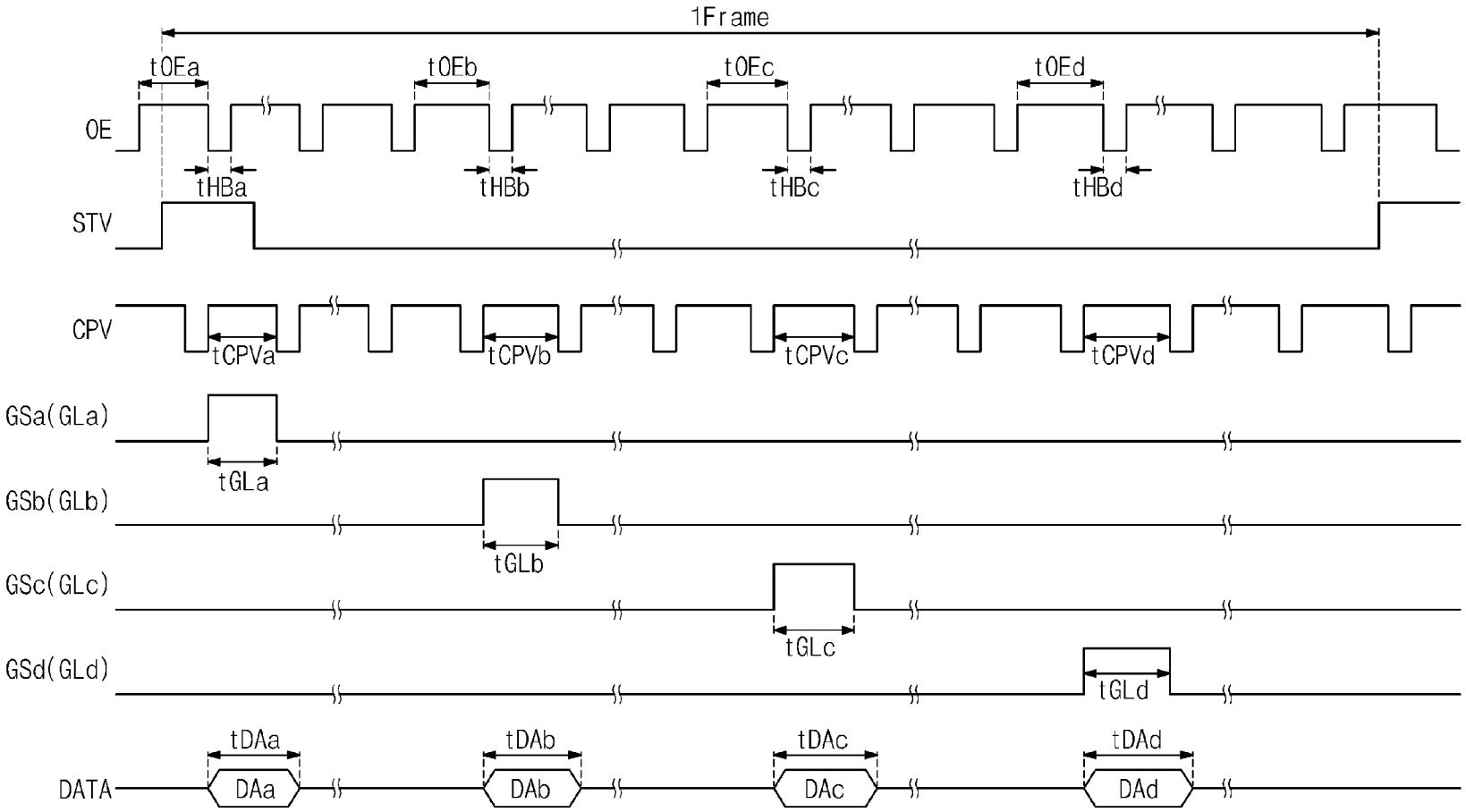
FIG. 7 is a timing diagram showing signals generated by the timing controller in FIG. 1 and used to drive a display panel shown in FIG. 6 according to exemplary embodiments of the invention.

FIG. 7 is a timing diagram showing signals generated by the timing controller 120 shown in FIG. 1 and used to drive the display panel 110 shown in FIG. 6.

Referring to FIGS. 6 and 7, the pulse width of each of n pulses of the output enable signal OE, i.e., the horizontal data period HD, becomes larger as the gate lines corresponding to the pulses are positioned further away from the data driver 140 in the first direction D1 (tOEa<tOEb<tOEc<tOEd). However, as shown in FIG. 7, the horizontal data periods HD in a single gate line of the display areas 110*a*, 110*b*, 110*c*, and 110*d* may be the same (e.g., $tOE_a=tOE_{a+1}=tOE_{a+2}= \ldots =tOE_{b-1}$, $tOE_b=tOE_{b+1}=tOE_{b+2}= \ldots =tOE_{c-1}$, $tOE_c=tOE_{c+1}=tOE_{c+2}= \ldots =tOE_{d-1}$, and $tOE_d=tOE_{d+1}=tOE_{d+2}= \ldots =tOE_n$). In addition, the widths of the n horizontal blank periods HB of the output enable signal OE are the same (tHBa=tHBb=tHBc=tHBd).

In some cases, the width of the n horizontal blank period HB of the output enable signal OE may become larger as the gate lines corresponding to the horizontal blank period HB are positioned further away from the data driver 140 in the first direction D1 (tHBa<tHBb<tHBc<tHBd).

In some cases, the pulse widths of the n pulses of the output enable signal OE may be the same (tOEa=tOEb=tOEc=tOEd); however, the width of the n horizontal blank period HB of the output enable signal OE becomes larger as the gate lines corresponding to the horizontal blank period HB are positioned further away from the data driver 140 in the first direction D1 (tHBa<tHBb<tHBc<tHBd).

Figure 8:
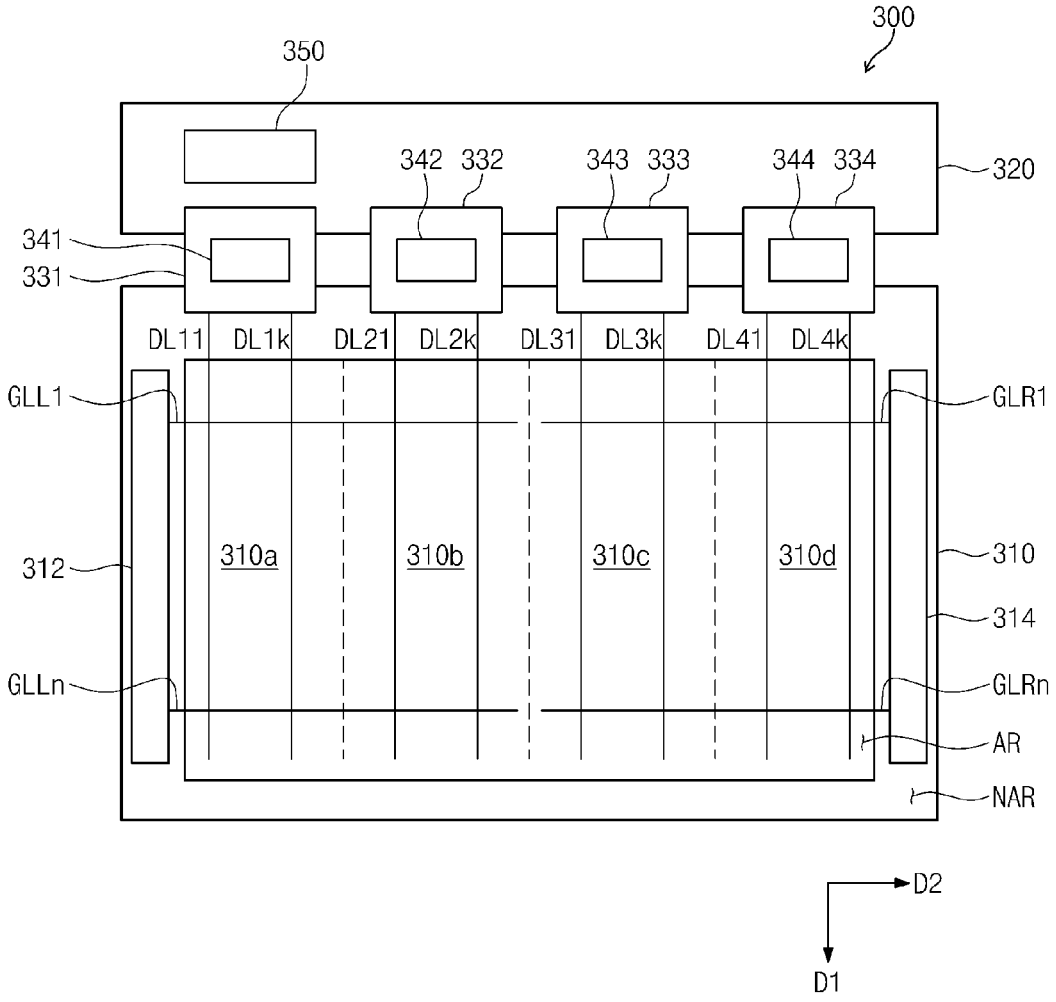
FIG. 8 is a plan view showing a display device according to exemplary embodiments of the invention.

FIG. 8 is a plan view showing a display device according to exemplary embodiments of the invention.

Referring to FIG. 8, a display device 300 includes a display panel 310, a circuit board 320, and a plurality of data driving circuits 331, 332, 333, and 334.

The display panel 310 may include a display area AR, in which a plurality of pixels is arranged, and a non-display area NAR disposed adjacent to the display area AR. The image is displayed in the display area AR and not displayed in the non-display area NAR. The non-display area NAR may surround one or more sides of the display area AR. The display panel 310 may employ a glass substrate, a silicon substrate, or a film substrate. The display panel 310 may include a first gate driving circuit 312 and a second gate driving circuit 314, which may be disposed in the non-display area NAR adjacent to two (e.g., left and right) sides of the display area AR.

The circuit board 320 may include a timing controller 350 to drive the display is panel 310 and a plurality of lines connected to the data driving circuits 331, 332, 333, and 334. In some cases, the data driving circuits 331, 332, 333, and 334 may be connected to one circuit board 320, and, in some cases, the data driving circuits 331, 332, 333, and 334 may be respectively connected to plural circuit boards. For instance, the data driving circuits 331 and 332 may be connected to a first circuit board (not shown), and the data driving circuits 333 and 334 may be connected to a second circuit board (not shown).

The timing controller 350 may apply a data signal DATA and a first control signal CONT1 to the data driving circuits 331, 332, 333, and 334, a second control signal CONT2 to the first gate driving circuit 312, and a third control signal CONT3 to the second gate driving circuit 314. The first control signal CONT1 may include a vertical synchronization start signal, a clock signal, and a line latch signal. The second control signal CONT2 may include a first vertical synchronization start signal STV1, a first output enable signal OE1, and a gate pulse signal CPV1. The third control signal CONT3 may include a second vertical synchronization start signal STV2, a second output enable signal OE2, and a gate pulse signal CPV2.

The data driving circuits 331, 332, 333, and 334 may be formed using a tape carrier package (TCP) method or a chip-on-film (COF) method, and data driver integrated circuits 341, 342, 343, and 344 may be respectively mounted on the data driving circuits 331, 332, 333, and 334. Each of the data driver integrated circuits 341, 342, 343, and 344 may drive the data lines in response to the data signal DATA and the first control signal CONT1. The data driver integrated circuits 341, 342, 343, and 344 may be directly mounted on the display panel 310 instead of being mounted on the circuit board 320.

The display area AR of the display panel 310 may include, for example, four sub-display areas 310*a*, 310*b*, 310*c*, and 310*d* respectively corresponding to the data driving circuits 331, 332, 333, and 334. Each of the sub-display areas 310*a*, 310*b*, 310*c*, and 310*d* may be driven by a corresponding data driving circuit of the data driving circuits 331, 332, 333, and 334. For instance, the sub-display area 310*a* may be driven by the data driving circuit 331, the sub-display area 310*b* may be driven by the data driving circuit 332, the sub-display area 310*c* may be driven by the data driving circuit 333, and the sub-display area 310*d* may be driven by the data driving circuit 334. In addition, gate lines GLL1 to GLLn may be arranged in the sub-display areas 310*a* and 310*b*, and the gate lines GLL1 to GLLn may be driven by the first gate driving circuit 312. Gate lines GLR1 to GLRn may be arranged in the sub-display areas 310*c* and 310*d*, and the gate lines GLR1 to GLRn may be driven by the second gate driving circuit 314. It should be understood that four sub-display areas are shown in FIG. 8 as an example, and that any suitable number of sub-display areas may be provided.

Among the four display areas 310*a*, 310*b*, 310*c*, and 310*d*, a delay time of the gate driving signals transmitting through the gate lines arranged in the sub-display areas 310*b* and 310*c* is longer than that of the gate driving signals transmitting through the gate lines arranged in the sub-display areas 310*a* and 310*d*. Therefore, the pulse width of the gate driving signals GSL1 to GSLn generated by the first gate driving circuit 312 is set in consideration of a direction in which the gate lines GLL1 to GLLn are scanned in the sub-display area 310*b*. The pulse width of the gate driving signals GSR1 to GSRn generated by the second gate driving circuit 314 is required to be set in consideration of a direction in which the gate lines GLR1 to GLRn are scanned in the sub-display area 310*c*.

Figure 9:
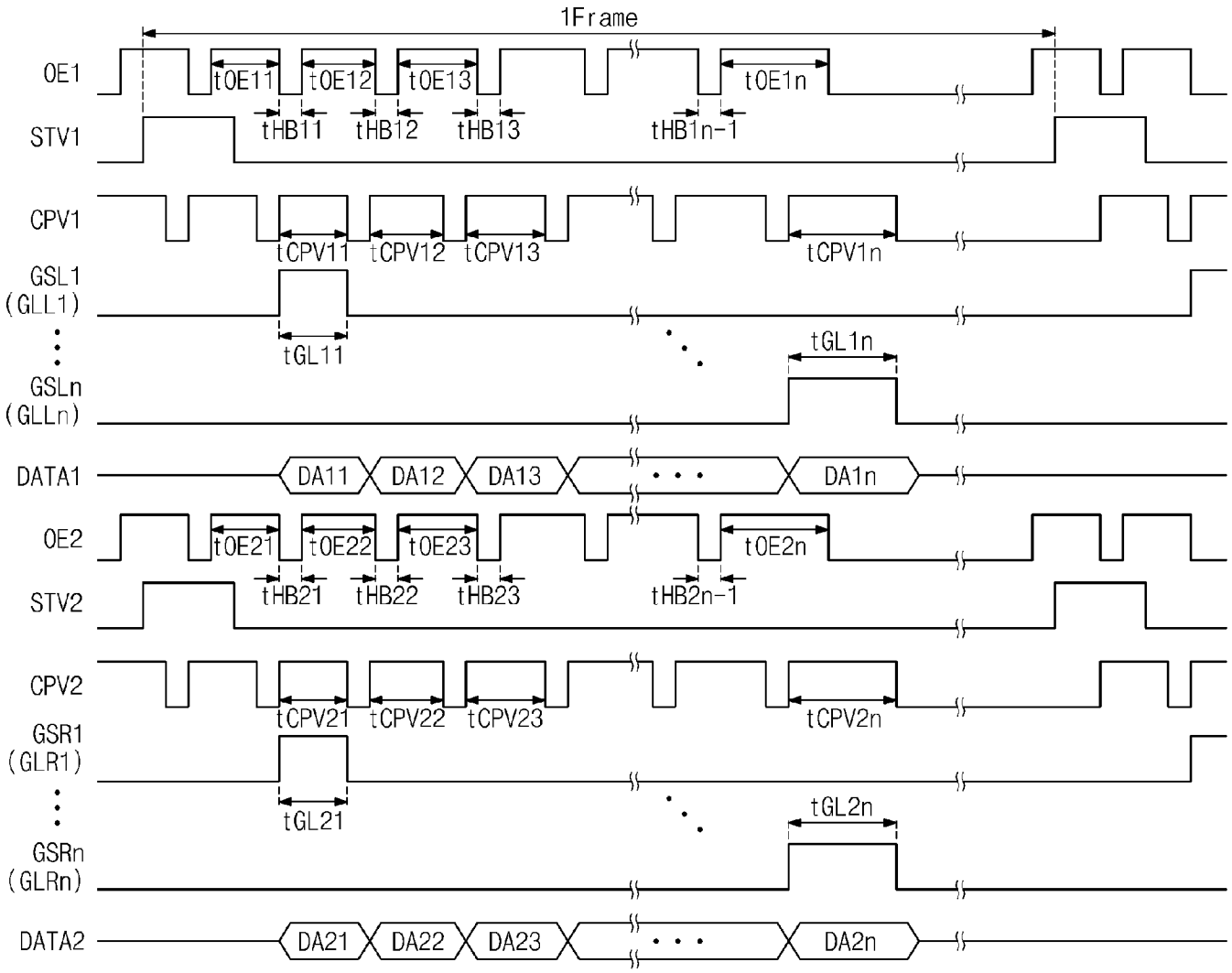
FIG. 9 is a timing diagram showing second and third control signals generated by is the timing controller in FIG. 8 and gate driving signals generated by first and second gate driving circuits according to exemplary embodiments of the invention.

FIG. 9 is a timing diagram showing second and third control signals generated by the timing controller 320 shown in FIG. 8 and gate driving signals generated by the first driving circuit 331 and the second gate driving circuit 332.

Referring to FIG. 9, a pulse width of each of n pulses of a first output enable signal OE1 becomes larger as the gate lines corresponding to the pulses are positioned further away from the data driving circuits 331 and 332 in the first direction D1 (tOE11<tOE12<tOE13< . . . <tOE1n). In addition, in some cases, widths of n horizontal blank periods HB in the first output enable signal OE1 may be the same (tHB11=tHB12= . . . =tHB1 n−1). In addition, the pulse widths of the first gate pulse signal CPV 1 generated in synchronization with the first output enable signal OE1 have an order of tCPV11<tCPV12<tCPV13< . . . <tCPV1n, and therefore the pulse widths of the gate driving signals GSL1 to GSLn applied to the gate lines GLL1 to GLLn have an order of tGL11<tGL12<tGL13< . . . <tGL1n.

In addition, a pulse width of each of n pulses of a second output enable signal OE2 becomes larger as the gate lines corresponding to the pulses are positioned further away from the data driving circuits 333 and 334 in the first direction D1 (tOE21<tOE22<tOE23< . . . <tOE2n). In some cases, widths of n horizontal blank periods HB in the second output enable signal OE2 are the same (tHB21=tHB22= . . . =tHB2n−1). In addition, the pulse widths of the second gate pulse signal CPV2 generated in synchronization with the second output enable signal OE2 have an order of tCPV21<tCPV22<tCPV23< . . . <tCPV2n, and, therefore, the pulse widths of the gate driving signals GSR1 to GSRn applied to the gate lines GLR1 to GLRn have an order of tGL21<tGL22<tGL23< . . . <tGL2n.

In some cases, the pulse widths of the n pulses of the first output enable signal OE1 may be the same (tOE11=tOE12=tOE13= . . . =tOE1n), but, the widths of the n horizontal blank periods of the first output enable signal OE1 may be set according to a direction in which the data driving signals are applied and a direction in which the gate lines GLL1 to GLLn, GLR1 to GLRn are scanned. For instance, the pulse width of the horizontal blank period HB corresponding to a pixel connected to a data driving line situated relatively further away from the data driving circuits 331, 332, 333, and 334 may be larger than a pulse width of a horizontal blank period HB corresponding to a pixel connected to a data driving line situated relatively closer to the data driving circuits 331, 332, 333, and 334. The widths of the n horizontal blank periods of the second output enable signal OE2 may also be set according to a direction in which the data driving signals are applied and a direction in which the gate lines are scanned.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a plurality of pixels configured by a plurality of gate lines and a plurality of data lines;

a data driver configured to drive the data lines in response to a first control signal and a data signal;

a gate driver configured to drive the gate lines in response to a second control signal; and a timing controller configured to apply the first control signal and the data signal to the data driver and the second control signal to the gate driver in response to receiving an image signal and a third control signal, wherein the timing controller is configured to periodically change a pulse width of each of the second control signal and the first control signal, wherein the second control signal comprises a gate pulse signal, and wherein the timing controller is configured to generate the gate pulse signal at a determined pulse width according to a relative position of each gate line in a first direction.

2. The display device of claim 1, wherein the timing controller is configured to provide an output enable signal, and to synchronously provide the output enable signal, the gate pulse signal, and the first control signal.

3. The display device of claim 2, wherein the timing controller comprises:

a frame memory configured to store the image signal and to output the data signal in response to the output enable signal; and a control signal generator configured to output the output enable signal, the gate pulse signal, and the first control signal.

4. The display device of claim 2, wherein the timing controller is configured to gradually increase a pulse width of the output enable signal for successive periods in one frame.

5. The display device of claim 2, wherein the timing controller is configured to gradually increase a pulse width of the output enable signal at determined time periods in one frame.

6. The display device of claim 5, wherein one horizontal period of the output enable signal comprises a horizontal blank period, and a width of the horizontal blank period in the output enable signal is uniform in every period of the output enable signal.

7. The display device of claim 6, wherein the width of the horizontal blank period of the output enable signal is gradually increased at the determined time periods.

8. The display device of claim 6, wherein a pulse width of the output enable signal is uniform in every period.

9. The display device of claim 3, wherein one horizontal period of the output enable signal comprises a horizontal blank period, and the width of the horizontal blank period of the output enable signal is gradually increased at determined periods of the output enable signal.

10. The display device of claim 3, wherein the control signal comprises a data enable signal, and the control signal generator is configured to generate the output enable signal using the data enable signal.

11. The display device of claim 3, wherein the data lines are extended in the first direction and the gate lines are extended in a second direction, and wherein the gate driver is configured to output a plurality of gate signals in response to the gate pulse signal.

12. The display device of claim 11, wherein the display panel comprises a plurality of display areas divided in the first direction, and each of the display areas comprises the gate lines.

13. The display device of claim 12, wherein the timing controller is configured to generate the gate pulse signal and a pulse width of each gate signal is set according to a position of each gate line in the first direction, the gate signals applied to the gate lines disposed in the same display area of the display areas having the same pulse width.

14. A display device, comprising:

a timing controller configured to provide a first control signal and a second control signal;

a gate driver configured to provide gate signals to a plurality of gate lines according to the second control signal; and a data driver configured to provide data signals to a plurality of data lines according to the first control signal, wherein a first gate line of the plurality of gate lines is disposed between the data driver and a second gate line of the plurality of gate lines, and wherein the gate driver is configured to set a pulse width of a first gate signal applied to the first gate line to be shorter than a pulse width of a second gate signal applied to the second gate line, wherein the second control signal comprises a gate pulse signal, and wherein the timing controller is configured to generate the gate pulse signal at a determined pulse width according to a relative position of each gate line in a first direction.

15. The display device of claim 14, further comprising:

a plurality of pixels each coupled to one of the plurality of data lines and one of the plurality of gate lines, a first pixel of the plurality of pixels being directly connected to the first gate line, and a second pixel of the plurality of pixels being directly connected to the second gate line, wherein a first capacitor in the first pixel is configured to be charged according to the first gate signal and a second capacitor in the second pixel is configured to be charged according to the second gate signal, the second capacitor being charged for a longer time than the first capacitor.

16. A display device, comprising:

a timing controller configured to provide a first control signal and a second control signal;

a gate driver configured to provide gate signals to a plurality of gate lines according to the second control signal, the plurality of gate lines comprising a first gate line and a second gate line; and a data driver configured to provide data signals to a plurality of data lines according to the first control signal, wherein a distance between the first gate line and the data driver and a distance between the second gate line and the data driver is different, and wherein the data driver is configured to set a pulse width of a first data signal to be applied to a transistor connected to the first gate line to be shorter than a pulse width of a second data signal to be applied to a transistor connected to the second gate line.

17. The display device of claim 16, wherein the gate driver is configured to set a pulse width of a first gate signal applied to the first gate line to be shorter than a pulse width of a second gate signal applied to the second gate line.

18. The display device of claim 16, further comprising:

a plurality of pixels each coupled to one of the plurality of data lines and one of the plurality of gate lines, a first pixel of the plurality of pixels being directly connected to the first gate line, and a second pixel of the plurality of pixels being directly connected to the second gate line, wherein a first capacitor in the first pixel is configured to be charged according to the first gate signal and a second capacitor in the second pixel is configured to be charged according to the second gate signal, the second capacitor being charged for a longer time than the first capacitor.

* * * * *